United States Patent [19]

Moritz

[11] 4,296,395

[45] Oct. 20, 1981

[54] STRUCTURE FOR PREVENTING WINDING COLLAPSE

[75] Inventor: Bertil Moritz, Vesteras, Sweden

[73] Assignee: ASEA Aktiebolag, Vesteras, Sweden

[21] Appl. No.: 90,699

[22] Filed: Nov. 2, 1979

[30] Foreign Application Priority Data

Nov. 9, 1978 [SE] Sweden ..... 7811561
Feb. 28, 1979 [SE] Sweden ..... 7901797

[51] Int. Cl.[3] ..... H01F 27/08; H01F 27/30

[52] U.S. Cl. ..... 336/60; 336/84 C; 336/197; 336/198; 336/223

[58] Field of Search ..... 336/84 R, 84 C, 69, 336/70, 223, 96, 60, 200, 227, 197, 196, 199, 207

[56] References Cited

U.S. PATENT DOCUMENTS

| | | | |
|---|---|---|---|
| 1,837,245 | 12/1931 | Wheeler | 336/70 X |
| 2,544,845 | 3/1951 | Link | 336/60 |
| 2,577,707 | 12/1951 | Kerns et al. | 336/84 C X |
| 3,142,029 | 7/1964 | Keen, Jr. et al. | 336/200 X |
| 3,265,998 | 8/1966 | Park | 336/96 X |
| 3,436,704 | 4/1969 | Keto et al. | 336/84 C X |
| 3,447,112 | 5/1969 | Broverman et al. | 336/60 |
| 4,035,751 | 7/1977 | Walthew | 336/60 |

OTHER PUBLICATIONS

Elektrotechnische Zeitschrift, 1952, No. 5, pp. 121–123.

*Primary Examiner*—Thomas J. Kozma
*Attorney, Agent, or Firm*—Watson, Cole, Grindle & Watson

[57] ABSTRACT

Certain windings in a transformer are subjected to radially inwardly-directed forces while being short-circuited. If such a winding is not sufficiently stable itself, particularly with respect to tape windings, or does not have sufficient support radially outwardly or inwardly, it will buckle or break. To prevent such an occurrence, it is possible to arrange an outward support around the winding by completely or partly filling up the space between the winding, which is subjected to buckling stress, and a second winding positioned outside the first winding. Additionally, there is required an inner supporting cylinder, which is preferably made of metal, so that it can be made relatively thin.

13 Claims, 6 Drawing Figures

STRUCTURE FOR PREVENTING WINDING COLLAPSE

BACKGROUND

1. Field of the Invention

The present invention relates to power transformers having at least two concentric windings arranged around a core leg, and more particularly to such structure including means for preventing winding collapse or buckling.

2. Prior Art

Upon short-circuiting of a transformer of the above-mentioned type the windings are subjected to axial and radial short-circuit forces. The radial forces for the windings outside the main leakage field are always directed outwardly, and for the windings inside the main leakage field the radial forces are directed inwardly towards the core leg. The outwardly directed forces cause tensile stresses in the respective winding, which are normally easy to cope with. The forces which act radially inwardly cause more problems since they tend to reduce the diameter of the winding in question, and if the winding itself is not sufficiently stable or does not have sufficient support radially outwardly or inwardly, it will buckle. This may damage the insulation so that short-circuiting between the winding turns occurs. Windings having conductors of metal foil strip are particularly difficult to make short-circuit proof. Of course, it is possible to increase the stiffness of such a winding by gluing together the different turns, but in the case of large power transformers such a method involves manufacturing difficulties. Moreover, the types of glue which could be used in this connection do not possess fully satisfactory long-term electrical strength.

Several proposals have been made to arrange support inwardly of the inner winding, i.e. between the winding and the core. Because of the elasticity of the supporting material, this method cannot fully prevent buckling, but only restrict the extent of the buckling.

SUMMARY OF THE INVENTION

The purpose of the present invention is to provide a short-circuit proof winding in a transformer having at least two concentric substantially cylindrical windings, wherein at least the innermost conductor winding consists of tape or foil. This is achieved by supporting the inner winding against the outer winding and includes an inner supporting cylinder of a metallic material.

The invention is based on the realization that a winding which is subjected to a radially inwardly-directed force and which has a surrounding outward support against a winding positioned outside it by the space between the two windings being filled with a solid material, may buckle only if the inner winding is initially of a non-round shape.

It has been proposed previously to allow the inner winding of a power transformer to support against the outer winding to avoid buckling (e.g., see Elektrotechnische Zeitschrift 1952, No. 5, pp. 121–123). A number of longitudinal supporting strips, spaced at a tangential distance from each other, are arranged in the channel between the inner and outer windings. However, the known embodiment is not concerned with tape windings but windings which have a relatively great stiffness.

In a tape winding, for example made of foils of a thickness of only 0.1 mm, an outward support is not sufficient, since the ring stress, generated upon a short-circuit, in the innermost turn of the winding is commensurate with a free buckling length (corresponding to a certain non-roundness of the winding turn) which is far below the values that may be achieved by practical manufacturing methods. According to the invention, a winding, which is subjected to a radially inwardly-directed force, is therefore provided with an inner supporting cylinder of such a thickness that the ring stress in the supporting cylinder upon a short-circuit current in the winding is less than the buckling stress for the free buckling length in the supporting cylinder which corresponds to the maximum tolerable non-roundness of the supporting cylinder. The extent of this non-roundness is determined with regard to the necessary manufacturing tolerances. By making the supporting cylinder of a material having a relatively high modulus of elasticity, preferably metal, several considerable advantages are achieved which will be explained in more detail in connection with the detailed description of the drawings.

In the manufacture of a transformer according to the present invention, it is extremely advantageous to co-wind the two windings with tensile prestress. By prestressing a winding which is subjected to a radially inwardly-directed force (the inner winding), a radial pressure of such magnitude can be achieved that freedom from play is ensured in spite of the fact that the conductor is usually not completely plane when wound. By prestressing the outside winding, the advantage is gained that the support in the channel between the windings also maintains its supporting function with the occurrence of the short-circuit when the outer winding diameter tends to increase and the inner winding diameter tends to decrease. During manufacture, the inner winding is suitably wound with a tensile stress and the free end of the winding is locked. Thereafter, for example, a mat of strips is wound one turn (alternatively, e.g., a plastic film may be wound several turns) around the periphery of the inner winding. The outer winding is then wound directly outside the mat with the tensile stress $\sigma_O$. If $\sigma_O$ is selected so that the mean compressive stress in the inner winding exceeds the mean stress upon a short-circuit, no play occurs in the cylindrical space between the windings during the short-circuit.

It may also be advantageous to choose a different distribution of the prestress, for example a low prestress on the inner winding and a high prestress on the outer winding. This may lead to a resulting compressive prestress in the supporting cylinder which is not much higher than the resulting compressive prestress in the inner winding.

In an inner prestressed tape winding of aluminum, creep may cause the prestress to gradually decrease and possibly completely disappear after a long time. According to a further development of the invention, this can be prevented by arranging, as support for the winding in the outward direction, an axially divided supporting cylinder making contact with the entire outer periphery of the winding. The supporting cylinder is preferably of metal and is, in turn, supported against the winding positioned outside the first winding by the aid of spaced longitudinal strips. The outer winding is wound on these strips with tensile prestress and therefore has a polygonal cross-section since the sections of the winding between the strips become straight. On the occurrence of a short-circuit, the outer winding attempts to assume a circular shape, whereby the straight winding sections are influenced by an outwardly-directed force, whereas the polygon corners are influenced by an inwardly-directed force which is transmitted, by way of the strips, to the outer supporting cylinder of the inner winding.

In a transformer according to the present invention with a supporting cylinder of electrically conductive material, it is suitable to provide the cylinder with a greater axial length than the average length of the windings. In this way, eddy current control of the magnetic field is achieved in a simple manner, with a resulting reduction of the current concentration in the inner area of the end portions of the inner winding. It is true that this way of controlling the magnetic field has been considered before, but then separate screens for this purpose have been proposed as described in U.S. Pat. No. 3,142,029.

BRIEF DESCRIPTION OF THE FIGURES

The invention is described in greater detail with reference to the embodiments shown in the accompanying drawing.

DETAILED DESCRIPTION

Figure 1:
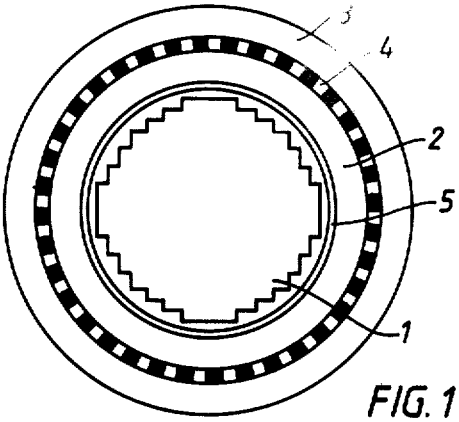
FIG. 1 shows a cross-section through a transformer core with inner and outer windings.

FIG. 1 shows a cross-section through leg 1 of an iron core for a power transformer. Core leg 1 is surrounded by inner winding 2 and outer winding 3. These windings are made as so-called tape windings. In such windings the conductor consists of tape (or foil) of, for example, aluminum, which is insulated in a suitable manner. The thickness of the tape may be, for example, only 0.1 mm.

Windings 2, 3 are coaxially arranged with an intermediate cylindrical space which is filled with a mat of strips 4. This may be built up of solid or hollow strips of, for example, glass-fiber, reinforced plastic, or pressboard. Alternatively, the space may be filled with a solid cylinder.

Inner winding 2 is wound on supporting cylinder 5, for example made of aluminum, which is considerably thicker than the conductor of the inner winding. The winding conductor is attached to supporting cylinder 5, which then constitutes part of the inner terminal bar of the winding. Supporting cylinder 5 has a longitudinally extending insulating slot, thus preventing a circulating short-circuit current in the cylinder.

Upon a short-circuit of the transformer, outer winding 3 is influenced by a radially outwardly-directed force and inner winding 2 is subjected to a radially inwardly-directed force. Outer winding 3 then maintains its round shape. Since inner winding 2 is supported by outer winding 3 all around, the inner winding may buckle only if supporting cylinder 5 has an initial non-roundness. Both the outer and inner windings cannot buckle if the radial stiffness in the winding is sufficiently great, since the total integrated tangential stress is zero.

By using supporting cylinder 5, which does not have to be particularly thick, the winding can be made with usual manufacturing tolerances without the risk of buckling. This is clear from the formulas (1) and (2) below, the significance of the used designations being indicated by FIG. 2.

Figure 2:
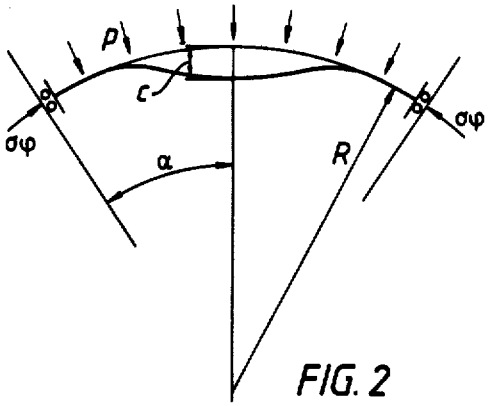
FIG. 2 shows a section of an externally pressureloaded ring for calculating the maximally allowable initial non-roundness of the ring in view of the risk of buckling.

FIG. 2 shows a section of a ring which is loaded with an evenly distributed radially inwardly-directed pressure p. It is assumed that the ring is supported outwardly by another ring which maintains its round shape. Buckling of the inner ring is then possible only if there is initial non-roundness. The magnitude of the non-roundness c (maximally allowable deviation from circular shape) and the corresponding free buckling length $R\alpha_{min}$ can be calculated from the following formulas:

$$\alpha_{min} = \frac{\pi}{\sqrt{\frac{12\sigma R^2}{Eh^2} + 1}} \tag{1}$$

$$c = \frac{4R}{\frac{12\sigma R^2}{Eh^2} + 1} \tag{2}$$

where

R = the radius of the ring;

h = the thickness of the ring in a radial direction;

E = the modulus of elasticity of the ring;

$\sigma$ = the mean ring compressive stress at maximum short-circuit current (in a tangential direction).

For a ring with radius R = 220 mm, radial thickness h = 0.1 mm, modulus of elasticity $E = 0.7 \cdot 10^5$ N/mm$^2$, and ring stress $\sigma = 44$ N/mm$^2$, a free buckling length $R\alpha_{min} = 3.62$ mm and a non-roundness c = 0.024 mm are obtained from equations (1) and (2).

If, instead, the radial thickness is increased to h = 4 mm, a free buckling length $R\alpha_{min} = 141.6$ mm and a non-roundness c = 36.95 mm are obtained, provided the other values are the same as in the preceding example.

The first example corresponds to a tape winding with a conductor thickness 0.1 mm without a supporting cylinder, whereas the second example corresponds to a tape winding with a supporting cylinder with a thickness 4 mm. The examples show that in case of transformer windings constructed of metal foil tape, which are supported around their entire outer periphery, there is also required an inner supporting cylinder, since non-roundnesses as small as 0.024 mm (according to the first example) cannot be achieved with practical manufacturing methods. As is clear from the second example, however, such a supporting cylinder does not have to be particularly thick. Compared with prior art constructions, therefore, a transformer according to the invention can be constructed with a smaller winding diameter, which results in considerable savings in costs. Moreover, the flow of coolant in the space between the inner winding and the core is improved, since the supporting cylinder does not need any inner supports which encroach upon this space to a degree worth mentioning.

With the stated formulas as the starting point, the following can be determined:

$$h = kR\sqrt{\sigma/E} \tag{3}$$

where k is a constant which is suitably between 0.5 and 5.

Figure 3:
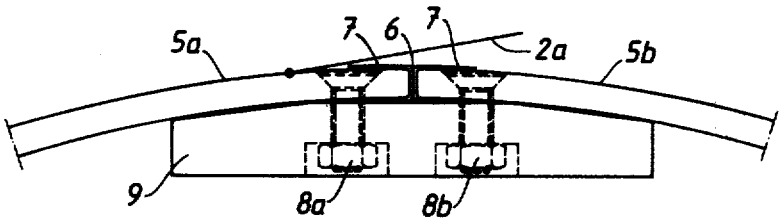
FIG. 3 shows a cross-section through the insulating slot in the supporting cylinder of the inner winding.

FIG. 3 shows how insulating slot 6 of supporting cylinder 5 may be arranged. One or several layers of glass fiber tape 7 or the like are applied around joint ends 5a, 5b of the supporting cylinder, which ends are fixed against each other by means of screws 8a, 8b arranged in longitudinally extending insulating strip 9. Inner end 2a of the tape winding is fastened by welding along one joint end 5a of supporting cylinder 5, in which screws 8a are tightened after tape winding 2 has been applied. Because of the tensile stress in the tape conductor, the joint ends of supporting cylinder 5 are then pressed against each other and compress insulating gap 6, which is favorable from a mechanical point of view. The cross-section form of insulating strip 9 can be easily adjusted to the stepped cross-section of the core, so that the strip does not cause any increase of the diameter of the winding.

Figure 4:
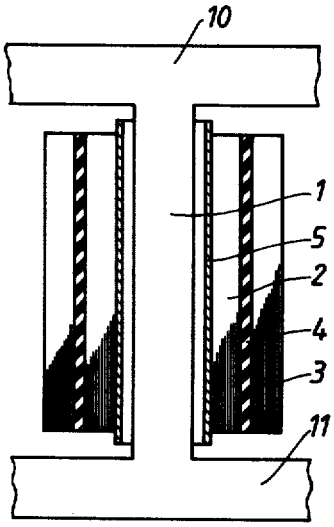
FIG. 4 shows a longitudinal section through a core leg having two windings.

FIG. 4 shows a section through leg 1 of a transformer core with upper and lower yokes 10 and 11, respectively. Core leg 1 supports supporting cylinder 5 of electrically conductive material, on which there is wound inner tape winding 2 and outside this outer winding 3. Cylindrical space 4 between the windings is filled with solid insulating material. Supporting cylinder 5 has a greater axial length than windings 2 and 3. In this way the portion of supporting cylinder 5 at the ends of the windings functions as an electrical shield, which reduces the radial component of the magnetic flux, whereby the current concentration at the inner edge of the end portions of inner tape winding 3 is reduced.

Figure 5:
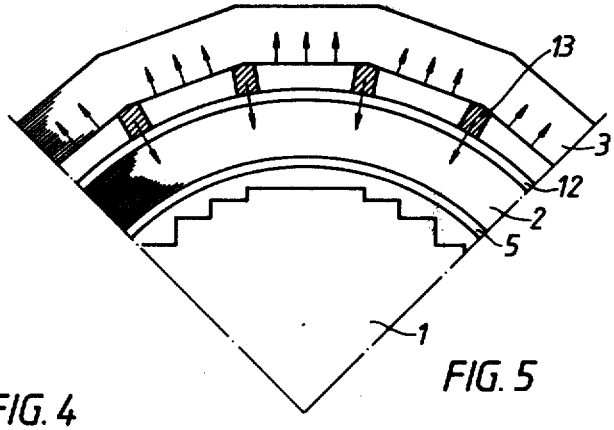
FIG. 5 shows part of a cross-section through a core leg with an alternative design of the windings.

FIG. 5 shows part of a cross-section through core leg 1 which is surrounded by inner tape winding 2 and outer tape winding 3. Inner winding 2 is wound on supporting cylinder 5 and has also outer supporting cylinder 12. Cylinders 5 and 12 are preferably made of metal, and outer cylinder 12 is suitably divided in the longitudinal direction into a number, for example four, of equally large sections, of which one may suitably serve as an outer terminal conductor for inner winding 2. Cylinder 12 is supported against outer winding 3 by means of spaced longitudinally extending strips 13. Outer winding 3 is wound on strips 13 with tensile prestress, thus giving the winding a polygonal cross-section. Upon a short-circuit current in the transformer, the winding sections between strips 13 are influenced by outwardly-directed forces, whereas the polygonal corners are influenced by inwardly-directed forces, as shown by arrows in FIG. 5. The inwardly-directed forces are transmitted via strips 13 and supporting cylinder 12 to the inner winding. This increases the friction between the turns of the inner winding, which results in a rigid construction.

In transformers having conductors of tape-formed material it may be suitable to make the inner winding with a greater axial length than the outer winding. Since the inner winding usually has lower voltage to earth than the outer winding, the inner winding can be drawn further out towards the yoke, the available winding space thus being utilized in a better way. At the same time the magnetic leakage flux occurring outside the winding ends is controlled, thus reducing the additional losses in the windings (see U.S. patent application Ser. No. 34,508, now U.S. Pat. No. 4,259,654 filed Apr. 30, 1979). In order to prevent local buckling of the outermost turns in that part of the inner winding which is located axially outside the outer winding, a ring girder 14 is suitably arranged around each end of the inner winding, as shown in FIG. 6.

The ring girder 14 is suitably made from tape-formed material and since there must be no gap between the inner winding 2 and the ring 14, the ring is suitably wound directly on its position around the winding 2, whereby the different turns are glued to each other. The ring girder 14 is advantageously made from a material which shrinks and is insulating, for example pressboard. The stiffness of the ring girder 14 should be considerably greater than the stiffness of a corresponding longitudinal section of the supporting cylinder 5.

Figure 6:
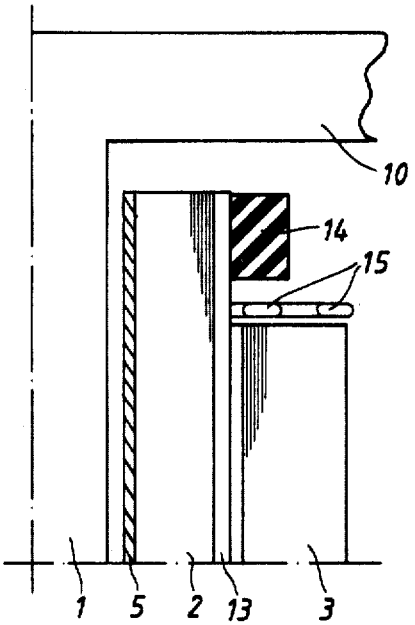
FIG. 6 shows details of a modified winding arrangement.

In the embodiment shown in FIG. 6, the ring girder 14 is arranged at a certain distance from the end of the outer winding 3, since the area nearest the winding end is occupied by screening rings 15. To provide support for the inner winding 2 in this area, the strips 13 in the channel between the inner and outer windings are drawn up to the end of the inner winding 2.

The invention is not limited to the embodiments shown but can be realized in many different ways without departing from the inventive concept. For example, there may be more than two, for example six, windings on each core leg, and not only the innermost winding may be subjected to a radial inwardly-directed force. Furthermore, both tape windings and windings of a conventional design may be present on the same transformer. The invention also contemplates the case when a tape winding, which is subjected to buckling stress, makes direct contact with a winding positioned outside it without any intermediate space.

What is claimed is:

1. A power transformer comprising at least two concentric, cylindrical windings, at least the innermost of which being wound from a conductor of tape or foil and having a circular cross-section, said innermost winding having an axial length greater than the axial length of an adjacent surrounding winding, an inner supporting cylinder made of metallic material for supporting said innermost winding, said inner supporting cylinder including a longitudinally extending, electrically insulating slot, and ring girders surrounding the ends of said innermost winding, said innermost winding being supported against said an adjacent surrounding winding and against said ring girders.

2. A power transformer according to claim 1, wherein said supporting cylinder has a radial thickness $$h = kR\sqrt{\sigma/E}$$

in which $0.5 < k < 5$,

R = the radius of the supporting cylinder,

E = the modulus of elasticity of the supporting cylinder, and $\sigma$ = the mean compressive stress in the inner winding at maximum short-circuit current.

3. A power transformer according to claim 1 or 2, wherein said supporting cylinder has greater axial length than the average length of said inner winding.

4. A power transformer according to claim 1 or 2, wherein said at least two cylindrical windings are wound with a tensile prestress of such a magnitude that the mean compressive stress in the inner winding exceeds the mean stress induced by a short-circuit.

5. A power transformer according to claim 1 or 2, wherein said at least two cylindrical windings are wound with a tensile prestress and the tensile prestress on the inner winding is considerably lower than on the outer winding.

6. A power transformer according to claim 1 or 2, wherein said supporting cylinder is a terminal conductor for said inner winding.

7. A power transformer according to claim 1 or 2, wherein said two windings are spaced a radial distance from each other, to form a cylindrical space therebetween, and said space is at least partially filled with a solid material.

8. A power transformer according to claim 1 or 2, wherein said two windings are spaced a radial distance from each other to form a cylindrical space therebetween and further comprising a mat of solid strip-like material at least partially filling said cylindrical space.

9. A power transformer according to claim 1 or 2, wherein said windings are spaced a radial distance from each other to form a cylindrical space therebetween and further comprising a cylindrical supporting body positioned within said cylindrical space.

10. A power transformer according to claim 1 or 2, wherein said two windings are spaced a radial distance from each other to form a cylindrical space therebetween and further comprising a supporting cylinder occupying said cylindrical space, said supporting cylinder being divided along its longitudinal axis and formed of metal to support said inner winding along the entire outer periphery thereof, said supporting cylinder being supported against said outer winding by longitudinally extending strips evenly distributed around the circumference of said supporting cylinder, said outer winding being wound on said longitudinally extending strips whereby said outer winding has a substantially polygonal cross section.

11. A power transformer according to claim 1 or 2, further comprising a longitudinal insulating strip bridging said insulating slot, said supporting cylinder having confronting ends fixed to said insulating strip.

12. A power transformer according to claim 1 or 2, wherein the conductor of the inner winding has a thickness substantially no greater than 1.5 mm.

13. A power transformer according to claim 1 or 2, wherein said two windings are spaced a radial distance from each other to form a cylindrical space therebetween and further comprising a mat of hollow strip-like material at least partially filling said cylindrical space.

* * * * *